US010107312B2

(12) United States Patent
Kondo et al.

(10) Patent No.: US 10,107,312 B2
(45) Date of Patent: Oct. 23, 2018

(54) HYDRAULIC SYSTEM

(71) Applicant: KAWASAKI JUKOGYO KABUSHIKI KAISHA, Kobe-shi, Hyogo (JP)

(72) Inventors: Akihiro Kondo, Nishinomiya (JP); Hideyasu Muraoka, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 15/557,911

(22) PCT Filed: Mar. 7, 2016

(86) PCT No.: PCT/JP2016/001229

§ 371 (c)(1),
(2) Date: Sep. 13, 2017

(87) PCT Pub. No.: WO2016/147596

PCT Pub. Date: Sep. 22, 2016

(65) Prior Publication Data

US 2018/0051721 A1 Feb. 22, 2018

(30) Foreign Application Priority Data

Mar. 13, 2015 (JP) ..... 2015-050466

(51) Int. Cl.
*F16K 31/02* (2006.01)
*F15B 13/042* (2006.01)
*F15B 13/044* (2006.01)

(52) U.S. Cl.
CPC ..... *F15B 13/0422* (2013.01); *F15B 13/0442* (2013.01)

(58) Field of Classification Search
CPC ..... F15B 13/0422; F15B 13/0442
(Continued)

(56) References Cited

U.S. PATENT DOCUMENTS 4,362,089 A * 12/1982 Melocik ..... F15B 13/0422 137/113
5,060,475 A * 10/1991 Latimer ..... F15B 13/0422 60/413

(Continued)

FOREIGN PATENT DOCUMENTS

JP 59-34009 A * 2/1984 ..... F15B 13/0422
JP 2011-117316 A 6/2011

*Primary Examiner* — Minh Le
(74) *Attorney, Agent, or Firm* — Oliff PLC

(57) ABSTRACT

A hydraulic system includes: a control valve including a first and second pilot port to move an actuator in a first and second direction respectively; a first line that connects between a pilot pressure source and first pilot port; a solenoid proportional valve provided on first line; a second line that branches off from first line at the solenoid proportional valve's position upstream and that is connected to second pilot port; a switching valve provided on the second line and including a spring to keep the switching valve in a closing position, wherein switching valve allows communication between second pilot port and tank, and a pilot port to shift the switching valve from closing to an opening position, wherein switching valve allows second pilot port to communicate with pilot pressure source; and a third line that connects between the switching valve's pilot port and a portion of the first line.

7 Claims, 5 Drawing Sheets

(58) Field of Classification Search
USPC ..... 137/487.5, 596.14, 596.16, 596.18; 91/169, 210, 217, 304, 305, 308, 461; 60/413, 452, 450
See application file for complete search history.

(56) References Cited

U.S. PATENT DOCUMENTS

| | | | | |
|---|---|---|---|---|
| 5,497,805 | A * | 3/1996 | Sunamura | E02F 9/22 137/596.16 |
| 5,862,828 | A * | 1/1999 | Dorfler | F15B 11/15 137/106 |
| 8,459,019 | B2 * | 6/2013 | Hohensee | F04B 27/067 60/430 |
| 8,464,753 | B2 * | 6/2013 | Schmidt | F15B 11/006 137/596.14 |
| 9,759,238 | B2 * | 9/2017 | Ku | F15B 13/0426 |
| 2009/0205723 | A1 * | 8/2009 | Saotome | F15B 13/0407 137/485 |
| 2013/0174915 | A1 * | 7/2013 | Tondolo | G05D 7/0617 137/2 |
| 2013/0269808 | A1 * | 10/2013 | Liukkunen | F16K 11/0716 137/596.14 |
| 2016/0032949 | A1 * | 2/2016 | Ueda | F15B 21/082 60/452 |

* cited by examiner

FIRST AND SECOND
OPERATION SIGNALS

HYDRAULIC SYSTEM

TECHNICAL FIELD

The present invention relates to a hydraulic system including a hydraulic actuator that moves bi-directionally.

BACKGROUND ART

Generally speaking, in a hydraulic system that electrically controls a hydraulic actuator that moves bi-directionally, a control valve connected to the hydraulic actuator, the control valve including first and second pilot ports, and a pair of solenoid proportional valves that outputs secondary pressures to the first and the second pilot ports, respectively, are used (see Patent Literature 1, for example).

CITATION LIST

Patent Literature

PTL 1: Japanese Laid-Open Patent Application Publication No. 2011-117316

SUMMARY OF INVENTION

Technical Problem

However, the use the pair of solenoid proportional valves increases the cost of the hydraulic circuit. Moreover, in this case, a controller that controls the solenoid proportional valves needs two current generators. This also increases the cost of the controller. Furthermore, since the number of pins of a connector connecting between the controller and the solenoid proportional valves is large, the connector needs to be large-sized.

In view of the above, an object of the present invention is to provide a hydraulic system capable of electrically controlling a hydraulic actuator that moves bi-directionally by using a single solenoid proportional valve.

Solution to Problem

In order to solve the above-described problems, a hydraulic system according to the present invention includes: a control valve connected to a hydraulic actuator and including a first pilot port to move the actuator in a first direction and a second pilot port to move the actuator in a second direction; a first line that connects between a pilot pressure source and the first pilot port; a solenoid proportional valve provided on the first line; a second line that branches off from the first line at a position upstream of the solenoid proportional valve and that is connected to the second pilot port; a switching valve that is provided on the second line and that shifts between a closing position, in which the switching valve allows the second pilot port to communicate with a tank, and an opening position, in which the switching valve allows the second pilot port to communicate with the pilot pressure source, the switching valve including a spring to keep the switching valve in the closing position and a pilot port to shift the switching valve from the closing position to the opening position; and a third line that connects between the pilot port of the switching valve and a portion of the first line, the portion being positioned downstream of the solenoid proportional valve.

According to the above configuration, the switching valve is positioned in the closing position when a secondary pressure of the solenoid proportional valve is low, and the switching valve is positioned in the opening position when the secondary pressure of the solenoid proportional valve is high. When the switching valve is positioned in the closing position, the control valve is driven by the secondary pressure of the solenoid proportional valve to a first position, in which the control valve causes the actuator to move in the first direction. When the switching valve is positioned in the opening position, the control valve is driven by the differential pressure between the pressure of the pilot pressure source and the secondary pressure of the solenoid proportional valve to a second position, in which the control valve causes the actuator to move in the second direction. This makes it possible to electrically control the hydraulic actuator, which moves bi-directionally, by using the single solenoid proportional valve. Moreover, since the switching valve acts automatically in accordance with the secondary pressure of the solenoid proportional valve, the controller needs only one current generator for the single control valve. This makes it possible to reduce the cost of the controller. Furthermore, since the number of solenoid proportional valves necessary for the single control valve is one, the number of pins of a connector connecting between the controller and the solenoid proportional valve is small. For this reason, a small-sized connector can be used, and the cost can be reduced also in this respect.

The switching valve may be configured to shift from the closing position to the opening position when a pressure led to the pilot port of the switching valve becomes a predetermined pressure or higher, and the predetermined pressure may be a half of a pressure of the pilot pressure source. According to this configuration, in both the case of moving the actuator in the first direction and the case of moving the actuator in the second direction, the control valve can be driven substantially in the same manner.

The solenoid proportional valve may be a direct proportional valve outputting a secondary pressure that indicates a positive correlation with a command current. According to this configuration, when a failure such as an electrical path being cut off occurs, the pressure of the first pilot port and the pressure of the second pilot port of the control valve can be brought to zero, and thereby the actuator can be assuredly prevented from moving.

The above hydraulic system may further include: an operating device that receives a first operation for moving the actuator in the first direction and a second operation for moving the actuator in the second direction, the operating device outputting a first operation signal corresponding to a magnitude of the first operation and a second operation signal corresponding to a magnitude of the second operation; and a controller that feeds the command current to the solenoid proportional valve. The controller may: increase the command current toward a reference current, at which the secondary pressure outputted from the solenoid proportional valve is the predetermined pressure, when the first operation signal increases; and decrease the command current toward the reference current when the second operation signal increases. According to this configuration, the actuator can be moved in accordance with the magnitude of the first operation and the magnitude of the second operation.

The command current when the first operation signal is maximum may be lower than the reference current, and the command current when the second operation signal is maximum may be higher than the reference current. According to this configuration, unstable action of the switching valve at a pressure close to the predetermined pressure can be avoided.

For example, the operating device may include an operating lever, and each of the first operation signal and the second operation signal may indicate an inclination angle of the operating lever.

Advantageous Effects of Invention

The present invention makes it possible to electrically control a hydraulic actuator that moves bi-directionally by using a single solenoid proportional valve.

DESCRIPTION OF EMBODIMENTS

Embodiment 1

Figure 1:
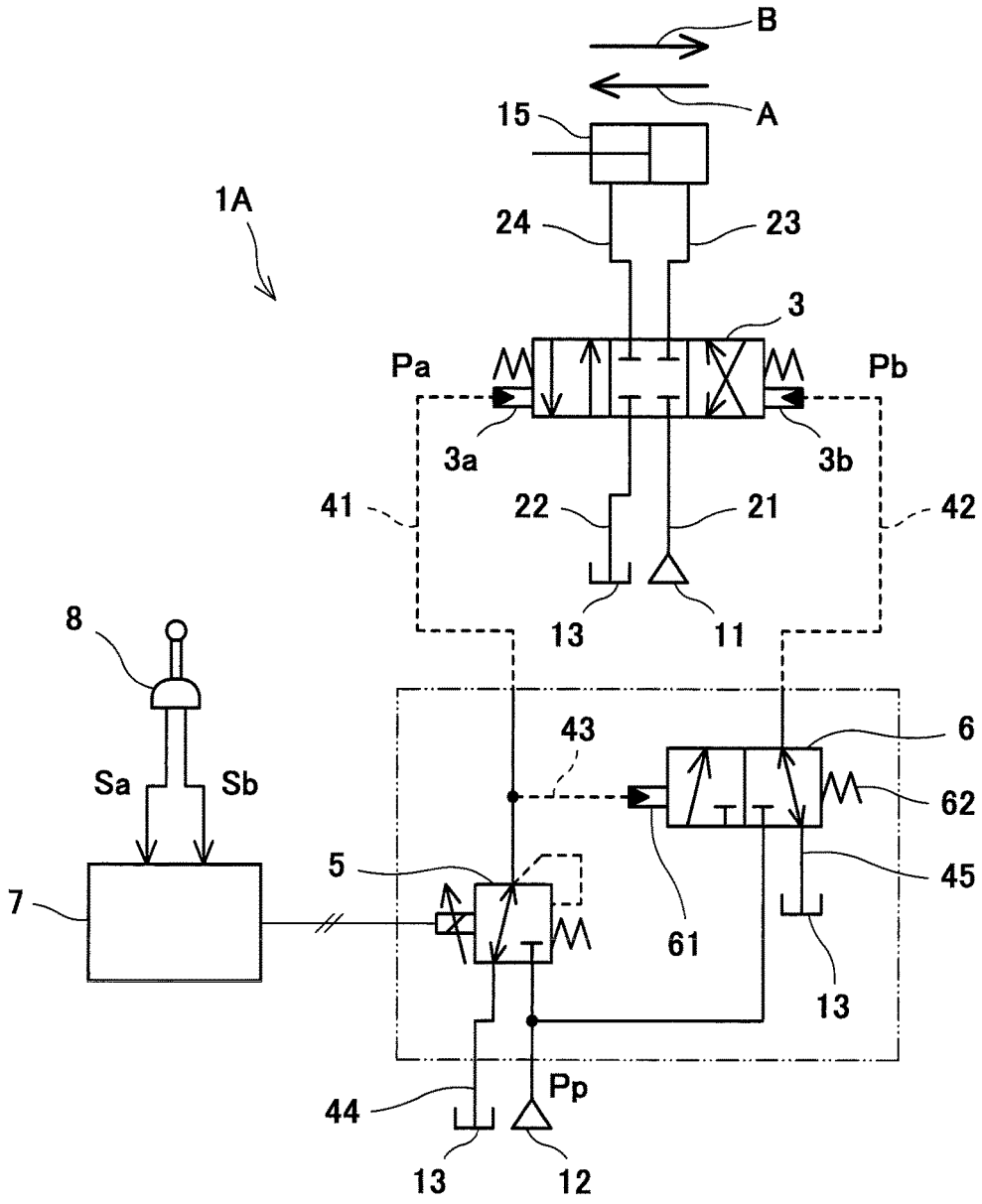
FIG. 1 shows a schematic configuration of a hydraulic system according to Embodiment 1 of the present invention.

FIG. 1 shows a hydraulic system 1A according to Embodiment 1 of the present invention. The hydraulic system 1A includes: a hydraulic actuator 15, which moves bi-directionally (in a first direction A and a second direction B); a control valve 3 connected to the actuator 15 by a pair of supply/discharge lines 23 and 24; and an operating device 8 operated by an operator.

In the example shown in FIG. 1, the actuator 15 is a hydraulic cylinder; the first direction A is an expanding direction; and the second direction B is a contracting direction. However, the actuator 15 is not limited to a hydraulic cylinder, but may be, for example, a hydraulic motor that rotates clockwise and counterclockwise.

The control valve 3 is connected to a main pressure source 11 by a supply line 21, and is connected to a tank 13 by a tank line 22. The control valve 3 is driven between a neutral position in which the control valve 3 blocks all the lines 21 to 24 connected to the control valve 3 and a first position (left-side position in FIG. 1) in which the control valve 3 allows one of the pair of supply/discharge lines 23 and 24 to communicate with the supply line 21 and allows the other supply/discharge line to communicate with the tank line 22, and also driven between the neutral position and a second position (right-side position in FIG. 1) in which the control valve 3 allows one of the pair of supply/discharge lines 23 and 24 to communicate with the supply line 21 and allows the other supply/discharge line to communicate with the tank line 22. It should be noted that, depending on the usage of the actuator 15, the control valve 3 may allow the supply/discharge lines 23 and 24 to communicate with the tank line 22 when the control valve 3 is in the neutral position.

To be more specific, the control valve 3 includes: a first pilot port 3*a* to drive the control valve 3 from the neutral position to the first position to move the actuator 15 in the first direction A; and a second pilot port 3*b* to drive the control valve 3 from the neutral position to the second position to move the actuator 15 in the second direction B.

The first pilot port 3*a* is connected to a pilot pressure source 12 by a first line 41. The first line 41 is provided with a solenoid proportional valve 5. That is, a secondary pressure outputted from the solenoid proportional valve 5 is led to the first pilot port 3*a*. The solenoid proportional valve 5 is connected to the tank 13 by a tank line 44.

Figure 2A:
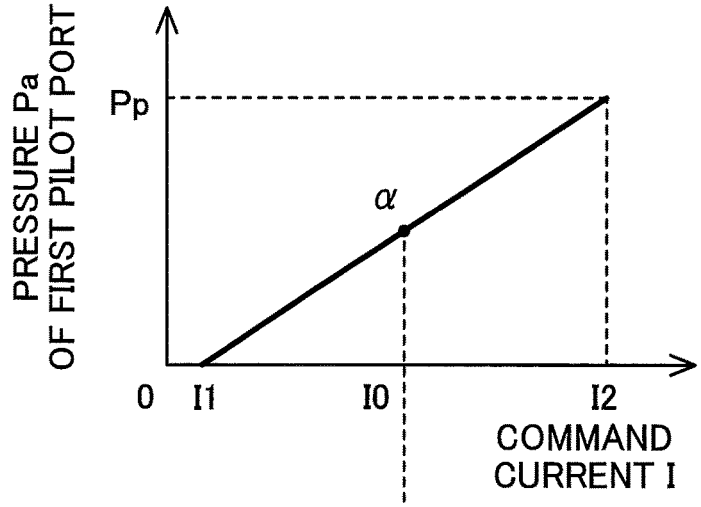
FIG. 2A is a graph showing a relationship between a command current outputted from a controller to a solenoid proportional valve and a pressure of a first pilot port.

A controller 7 feeds a command current I to the solenoid proportional valve 5. In the present embodiment, as shown in FIG. 2A, the solenoid proportional valve 5 is a direct proportional valve outputting a secondary pressure that indicates a positive correlation with the command current I. It should be noted that the maximum value of the secondary pressure outputted from the solenoid proportional valve 5, i.e., the maximum value of a pressure Pa led to the first pilot port 3*a*, is equal to a pressure Pp of the pilot pressure source 12. In FIG. 2A, I1 indicates a minimum current at which the solenoid proportional valve 5 starts outputting the secondary pressure, and I2 indicates a maximum current at which the secondary pressure of the solenoid proportional valve 5 is the maximum pressure.

Returning to FIG. 1, a second line 42 branches off from the first line 41 at a position upstream of the solenoid proportional valve 5. The second line 42 is connected to the second pilot port 3*b*. The second line 42 is provided with a switching valve 6. The switching valve 6 is connected to the tank 13 by a tank line 45.

The switching valve 6 shifts between a closing position in which the switching valve 6 allows the second pilot port 3*b* to communicate with the tank 13 and an opening position in which the switching valve 6 allows the second pilot port 3*b* to communicate with the pilot pressure source 12. In the present embodiment, the switching valve 6 is a pilot valve, and includes a spring 62 to keep the switching valve 6 in the closing position and a pilot port 61 to shift the switching valve 6 from the closing position to the opening position. The pilot port 61 is connected by a third line 43 to the first line 41 at a position downstream of the solenoid proportional valve 5.

The switching valve 6 may be a single valve connected to piping. However, as indicated by a two-dot chain line of FIG. 1, the switching valve 6 may be formed inside a housing together with the solenoid proportional valve 5. In this case, a portion of the first line 41 (the portion being close to the solenoid proportional valve 5), an upstream portion of the second line 42, and the third line 43 are also formed inside the housing. This configuration allows a pilot valve unit including the housing to be readily attached to the control valve 3.

Figure 2B:
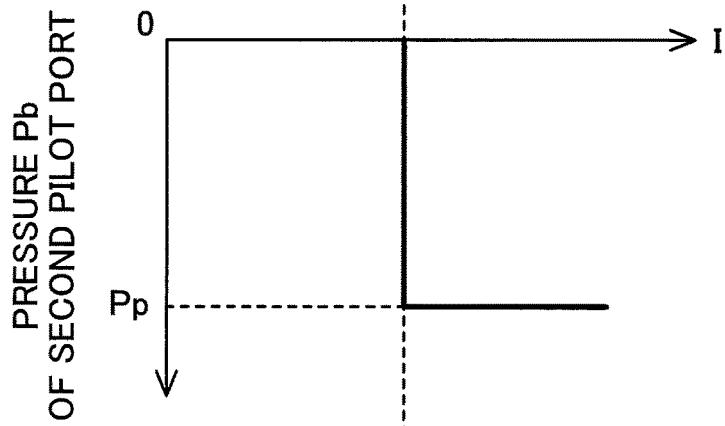
FIG. 2B is a graph showing a relationship between the command current and a pressure of a second pilot port.

The switching valve 6 is configured to shift from the closing position to the opening position when a pressure led to the pilot port 61 of the switching valve 6, i.e., the secondary pressure outputted from the solenoid proportional valve 5, becomes a predetermined pressure $\alpha$ or higher. Accordingly, as shown in FIG. 2B, in a case where the command current I is lower than a reference current I0, at which the secondary pressure outputted from the solenoid proportional valve 5 is a predetermined pressure $\alpha$, a pressure Pb of the second pilot port 3*b* is zero. In a case where the command current I is not lower than the reference current I0, the pressure Pb of the second pilot port 3*b* is the pressure Pp of the pilot pressure source 12.

Figure 2C:
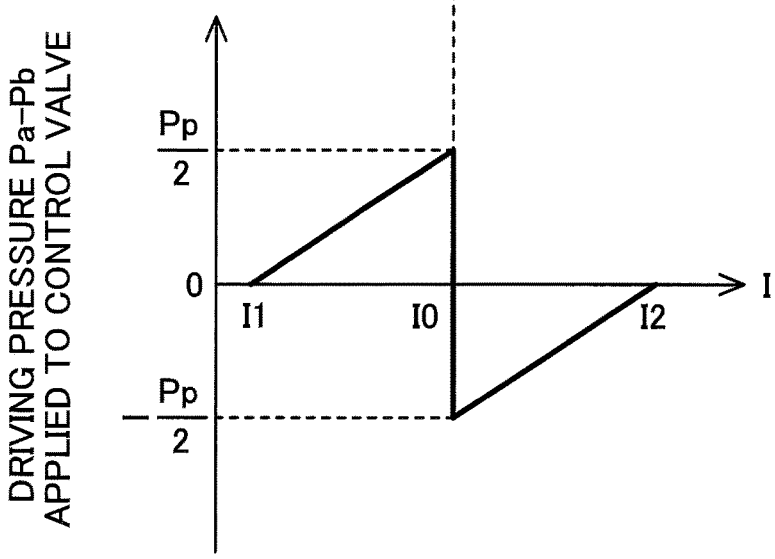
FIG. 2C is a graph showing a relationship between the command current and a driving pressure applied to a control valve.

Therefore, as shown in FIG. 2C, in the case where the command current I is lower than the reference current I0, the secondary pressure of the solenoid proportional valve 5 is applied to the control valve 3 as a driving pressure that drives the control valve 3 to the first position. On the other hand, in the case where the command current I is not lower than the reference current I0, the differential pressure between the pressure Pp of the pilot pressure source 12 and the secondary pressure of the solenoid proportional valve 5 is applied to the control valve 3 as a driving pressure that drives the control valve 3 to the second position.

In the present embodiment, the predetermined pressure α, which causes the switching valve 6 to shift from the closing position to the opening position, is the half of the pressure Pp of the pilot pressure source 12. The term "half" herein means a range that is substantially equal to Pp/2 (a range that covers ±20% from Pp/2). Accordingly, as shown in FIG. 2C, the driving pressure applied to the control valve 3 is substantially symmetrical between I1 to I0 and I0 to I2. In other words, in both the case of moving the actuator 15 in the first direction and the case of moving the actuator 15 in the second direction, the control valve 3 can be driven substantially in the same manner.

Returning to FIG. 1, the aforementioned operating device 8 is connected to the controller 7, which feeds the command current I to the solenoid proportional valve 5. The operating device 8 receives a first operation for moving the actuator 15 in the first direction A and a second operation for moving the actuator 15 in the second direction B. The operating device 8 outputs a first operation signal Sa and a second operation signal Sb to the controller 7. The first operation signal Sa corresponds to the magnitude of the first operation. The second operation signal Sb corresponds to the magnitude of the second operation.

The operating device 8 is, for example, an electrical joystick that includes an operating lever. In this case, each of the first operation signal Sa and the second operation signal Sb indicates an inclination angle of the operating lever. However, as an alternative example, the operating device 8 may be an operating valve that outputs a first pilot pressure corresponding to the inclination angle of the operating lever when the operating lever is inclined to one side and outputs a second pilot pressure corresponding to the inclination angle of the operating lever when the operating lever is inclined to the other side. In this case, a pair of pressure sensors that measures the first and the second pilot pressures may be provided, and the measured first and second pilot pressures may be inputted to the controller 7. As another alternative example, the operating device 8 need not be limited to one including the operating lever, but may be one including a handle that receives turning operations as the first operation and the second operation.

Figure 3:
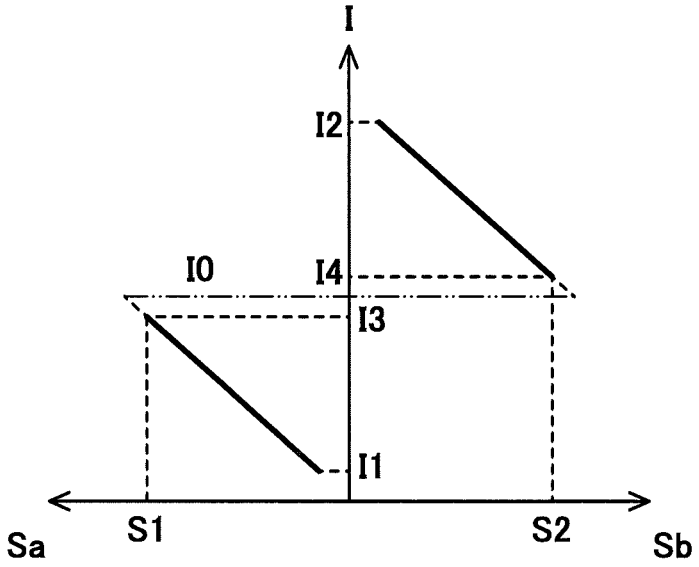
FIG. 3 is a graph showing a relationship between the command current and first and second operations.

The controller 7 does not feed the command current I to the solenoid proportional valve 5 when neither the first operation signal Sa nor the second operation signal Sb is outputted from the operating device 8. On the other hand, when the first operation signal Sa is outputted from the operating device 8, the controller 7 feeds the command current I to the solenoid proportional valve 5 in accordance with the first operation signal Sa as shown in FIG. 3. When the second operation signal Sb is outputted from the operating device 8, the controller 7 feeds the command current I to the solenoid proportional valve 5 in accordance with the second operation signal Sb as shown in FIG. 3. Accordingly, when the actuator 15 is not moved and when the actuator 15 is moved in the first direction A, the switching valve 6 is positioned in the closing position. When the actuator 15 is moved in the second direction B, the switching valve 6 is positioned in the opening position.

To be more specific, when the first operation signal Sa increases, the controller 7 increases the command current I from the minimum current I1 toward the reference current I0, and when the second operation signal Sb increases, the controller 7 decreases the command current I from the maximum current I2 toward the reference current I0. In this manner, the actuator 15 can be moved in accordance with the magnitude of the first operation and the magnitude of the second operation.

Desirably, a command current I3 when the first operation signal Sa is a maximum signal 51 is lower than the reference current I0, and a command current I4 when the second operation signal Sb is a maximum signal S2 is higher than the reference current I0. The reason for this is that unstable action of the switching valve 6 at a pressure close to the predetermined pressure α, which causes the switching valve 6 to shift from the closing position to the opening position, can be avoided.

As described above, in the hydraulic system 1A according to the present embodiment, the switching valve 6 is positioned in the closing position when the secondary pressure of the solenoid proportional valve 5 is low, and the switching valve 6 is positioned in the opening position when the secondary pressure of the solenoid proportional valve 5 is high. When the switching valve 6 is positioned in the closing position, the control valve 3 is driven by the secondary pressure of the solenoid proportional valve 5 to the first position, and when the switching valve 6 is positioned in the opening position, the control valve 3 is driven by the differential pressure between the pressure Pp of the pilot pressure source 12 and the secondary pressure of the solenoid proportional valve 5 to the second position. This makes it possible to electrically control the hydraulic actuator 15, which moves bi-directionally, by using the single solenoid proportional valve 5. Moreover, since the switching valve 6 acts automatically in accordance with the secondary pressure of the solenoid proportional valve 5, the controller 7 needs only one current generator for the single control valve 3. This makes it possible to reduce the cost of the controller 7. Furthermore, since the number of solenoid proportional valves 5 necessary for the single control valve 3 is one, the number of pins of a connector connecting between the controller 7 and the solenoid proportional valve 5 is small. For this reason, a small-sized connector can be used, and the cost can be reduced also in this respect.

In the present embodiment, the solenoid proportional valve 5 is a direct proportional valve, and the switching valve 6 is normally kept in the closing position. Therefore, when a failure such as an electrical path being cut off occurs, the pressure Pa of the first pilot port 3*a* and the pressure Pb of the second pilot port 3*b* of the control valve 3 can be brought to zero, and thereby the actuator 15 can be assuredly prevented from moving.

Embodiment 2

Figure 4:
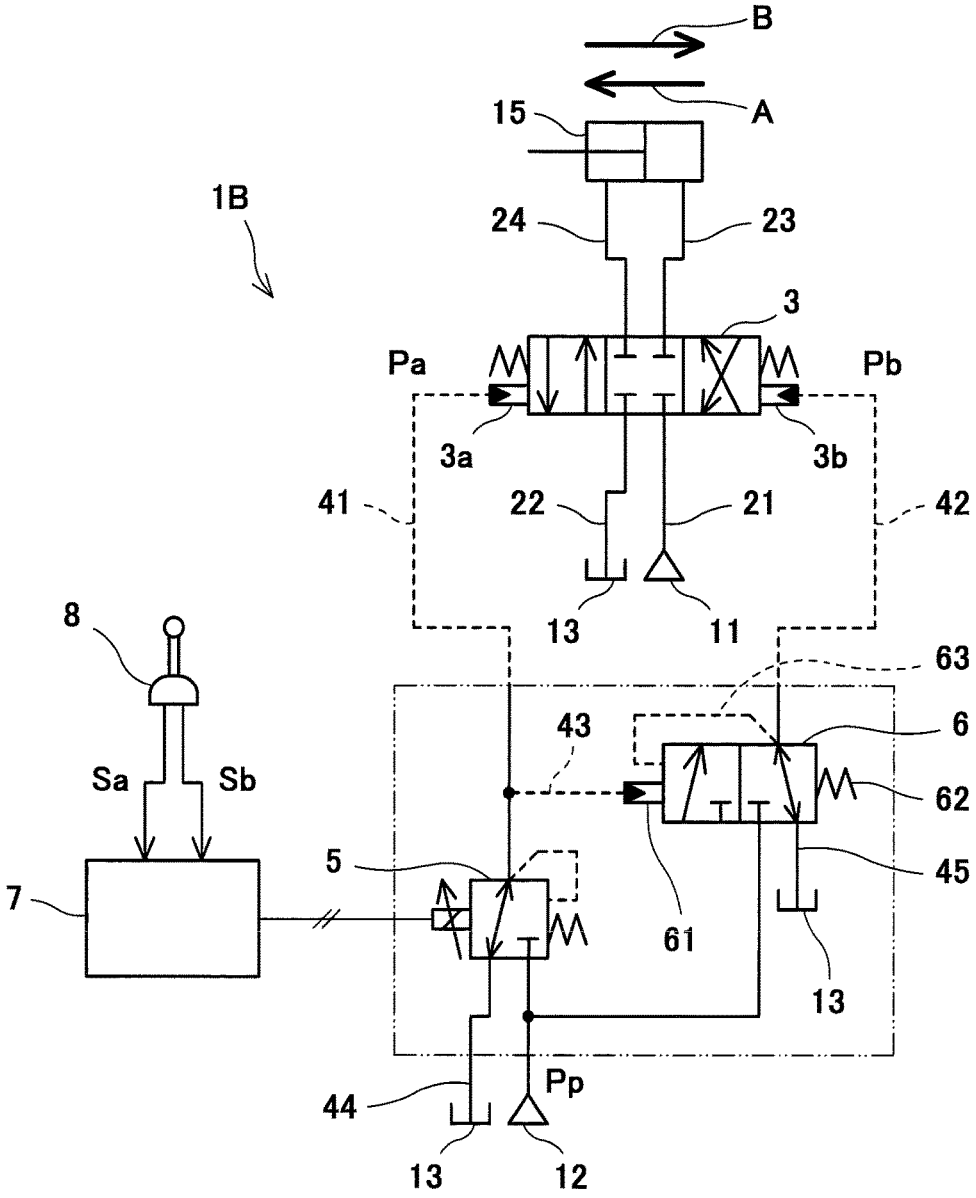
FIG. 4 shows a schematic configuration of a hydraulic system according to Embodiment 2 of the present invention.

Next, a hydraulic system 1B according to Embodiment 2 of the present invention is described with reference to FIG. 4. In the present embodiment and Embodiment 3 described below, the same components as those described in Embodiment 1 are denoted by the same reference signs as those used in Embodiment 1, and repeating the same descriptions is avoided.

In the present embodiment, the switching valve 6 is provided with an assist passage 63 for assisting in keeping the switching valve 6 in the opening position when the switching valve 6 shifts from the closing position to the opening position. It should be noted that, desirably, a pushing force applied through the assist passage 63 is sufficiently less than the urging force of the spring 62, which serves to return the switching valve 6 from the opening position to the closing position.

The above configuration makes it possible to obtain an advantageous effect that the switching valve 6 shifted to the opening position can be stably kept in the opening position in addition to the advantageous effects obtained in Embodiment 1.

Embodiment 3

Figure 5:
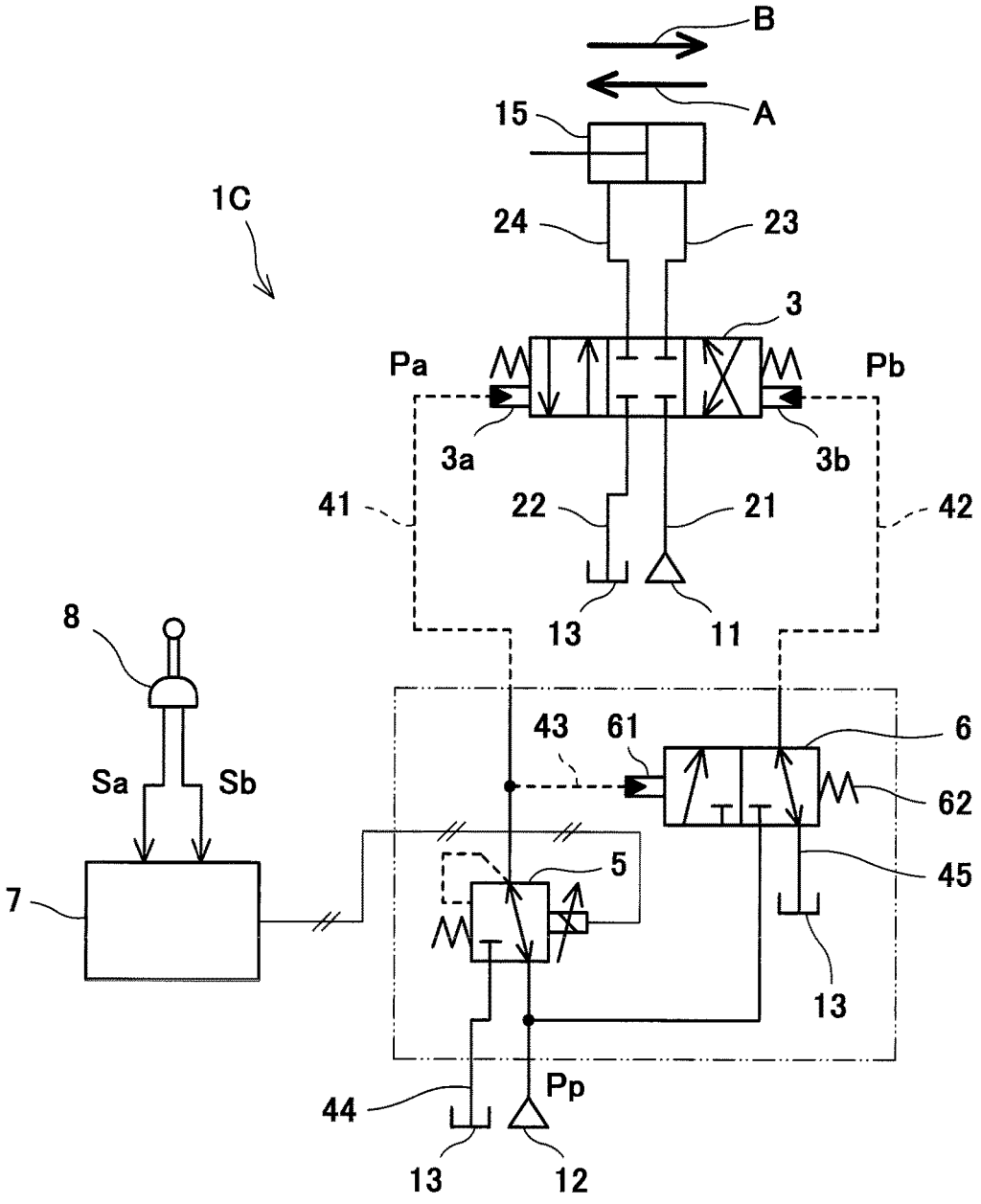
FIG. 5 shows a schematic configuration of a hydraulic system according to Embodiment 3 of the present invention.

Next, a hydraulic system 1C according to Embodiment 3 of the present invention is described with reference to FIG. 5. In the present embodiment, the solenoid proportional valve 5 is an inverse proportional valve, that is, the command current I and the secondary pressure indicate a negative correlation.

Also in the present embodiment, the same advantageous effects as those obtained in Embodiment 1 can be obtained except when a failure occurs. When a failure occurs, both the pressure Pa of the first pilot port 3*a* and the pressure Pb of the second pilot port 3*b* of the control valve 3 are brought to the pressure Pp of the pilot pressure source 12, and thereby the actuator 15 is prevented from moving.

Other Embodiments

The present invention is not limited to the above-described Embodiments 1 to 3. Various modifications can be made without departing from the spirit of the present invention.

For example, in Embodiment 3, similar to Embodiment 2, the switching valve 6 may be provided with the assist passage 63 for assisting in keeping the switching valve 6 in the opening position when the switching valve 6 shifts from the closing position to the opening position. It should be noted that, desirably, a pushing force applied through the assist passage 63 is sufficiently less than the urging force of the spring 62, which serves to return the switching valve 6 from the opening position to the closing position.

REFERENCE SIGNS LIST

1A to 1C hydraulic system
12 pilot pressure source
15 hydraulic actuator
3 control valve
3*a* first pilot port
3*b* second pilot port
41 first line
42 second line
43 third line
5 solenoid proportional valve
6 switching valve
61 pilot port
62 spring
7 controller
8 operating device

The invention claimed is:

1. A hydraulic system comprising:

a control valve connected to a hydraulic actuator and including a first pilot port to move the actuator in a first direction and a second pilot port to move the actuator in a second direction;

a first line that connects between a pilot pressure source and the first pilot port;

a solenoid proportional valve provided on the first line;

a second line that branches off from the first line at a position upstream of the solenoid proportional valve and that is connected to the second pilot port;

a switching valve that is provided on the second line and that shifts between a closing position, in which the switching valve allows the second pilot port to communicate with a tank, and an opening position, in which the switching valve allows the second pilot port to communicate with the pilot pressure source, the switching valve including a spring to keep the switching valve in the closing position and a pilot port to shift the switching valve from the closing position to the opening position; and a third line that connects between the pilot port of the switching valve and a portion of the first line, the portion being positioned downstream of the solenoid proportional valve.

2. The hydraulic system according to claim 1, wherein the switching valve is configured to shift from the closing position to the opening position when a pressure led to the pilot port of the switching valve becomes a predetermined pressure or higher, and the predetermined pressure is a half of a pressure of the pilot pressure source.

3. The hydraulic system according to claim 2, wherein the solenoid proportional valve is a direct proportional valve outputting a secondary pressure that indicates a positive correlation with a command current.

4. The hydraulic system according to claim 3, further comprising:

an operating device that receives a first operation for moving the actuator in the first direction and a second operation for moving the actuator in the second direction, the operating device outputting a first operation signal corresponding to a magnitude of the first operation and a second operation signal corresponding to a magnitude of the second operation; and a controller that feeds the command current to the solenoid proportional valve, wherein the controller:

increases the command current toward a reference current, at which the secondary pressure outputted from the solenoid proportional valve is the predetermined pressure, when the first operation signal increases; and decreases the command current toward the reference current when the second operation signal increases.

5. The hydraulic system according to claim 4, wherein the command current when the first operation signal is maximum is lower than the reference current, and the command current when the second operation signal is maximum is higher than the reference current.

6. The hydraulic system according to claim 4, wherein the operating device includes an operating lever, and each of the first operation signal and the second operation signal indicates an inclination angle of the operating lever.

7. The hydraulic system according to claim 5, wherein the operating device includes an operating lever, and each of the first operation signal and the second operation signal indicates an inclination angle of the operating lever.

* * * * *